United States Patent [19]

Mimino et al.

[11] 3,969,161

[45] *July 13, 1976

[54] CR-NI SYSTEM AUSTENITIC HEAT-RESISTING STEEL

[75] Inventors: Tohru Mimino, Tokyo; Kazuhisa Kinoshita, Yokohama; Takayuki Shinoda, Tokyo; Isao Minegishi, Yokohama, all of Japan

[73] Assignee: Nippon Kokan Kabushiki Kaisha, Tokyo, Japan

[ * ] Notice: The portion of the term of this patent subsequent to May 18, 1993, has been disclaimed.

[22] Filed: Feb. 11, 1974

[21] Appl. No.: 441,225

Related U.S. Application Data

[63] Continuation-in-part of Ser. No. 413,629, Nov. 7, 1973, abandoned.

[52] U.S. Cl. ..... 148/38; 75/128 G; 75/128 T

[51] Int. Cl.[2] ..... C22C 38/48; C22C 38/50

[58] Field of Search ..... 148/38; 75/128 T, 128 G, 75/128 A

[56] References Cited

UNITED STATES PATENTS

| | | | |
|---|---|---|---|
| 2,067,630 | 1/1937 | Franks | 75/128 G X |
| 2,067,631 | 1/1937 | Becket | 75/128 G X |
| 2,159,497 | 5/1939 | Becket | 75/128 G X |
| 2,590,074 | 3/1952 | Bloom | 148/1 |
| 2,758,025 | 8/1956 | Clarke | 75/128 G X |
| 2,862,102 | 11/1958 | Heuschkel | 219/137 |
| 3,284,250 | 1/1966 | Yeo et al. | 75/128 G X |
| 3,303,023 | 2/1967 | Dulis et al. | 75/128 T X |

FOREIGN PATENTS OR APPLICATIONS

| | | | |
|---|---|---|---|
| 1,190,515 | 5/1970 | United Kingdom | 75/128 G |
| 1,191,048 | 5/1970 | United Kingdom | 75/128 T |
| 1,218,927 | 1/1971 | United Kingdom | 75/128 G |

*Primary Examiner*—Arthur J. Steiner
*Attorney, Agent, or Firm*—William A. Drucker

[57] ABSTRACT

Cr-Ni system austenitic heat-resisting steel exhibiting higher heat resistance than that of well-known austenitic stainless steels by means of which an atomic ratio of C being 0.05 to 0.30% to Ti being 0.01 to 0.8% and/or Nb (Ta) being 0.01 to 1.6% is within the range of 1.3 to 7, preferably 3 to 6 and the grain size is within the range of ASTM No. 3 to 8.

3 Claims, 1 Drawing Figure

CR-NI SYSTEM AUSTENITIC HEAT-RESISTING STEEL

Figure 1:
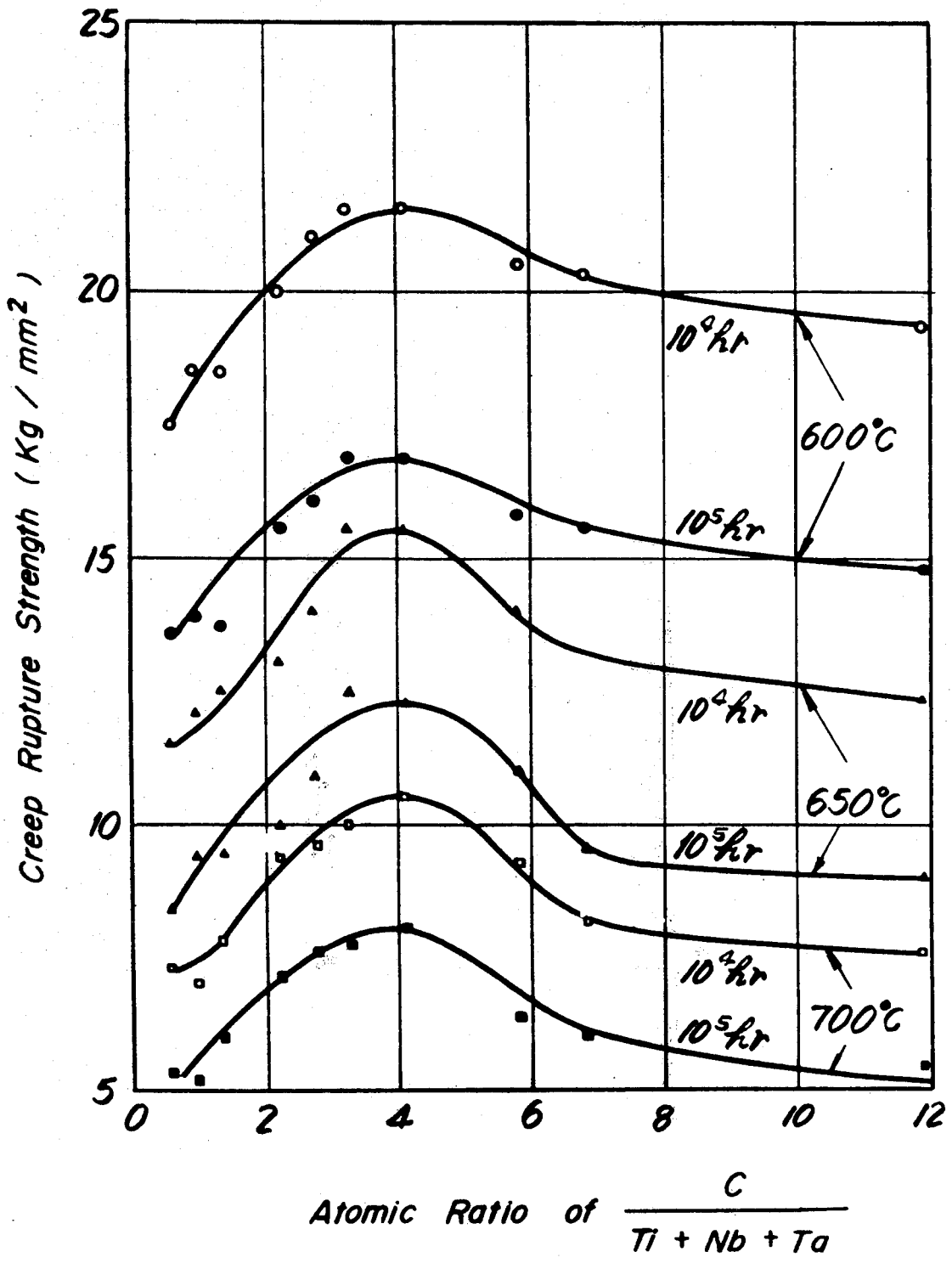

The present application is a Continuation-In-Part copending application Ser. No. 413,629 filed Nov. 7, 1973, now abandoned.

BACKGROUND OF THE INVENTION:

This invention relates to a composition and grain size for improving the heat resistance of Cr-Ni system austenitic stainless steels to use for a long period of time at elevated temperatures.

DESCRIPTION OF THE PRIOR ART

It is well-known that high strength and oxidation resistance of steel used for long periods of time at elevated temperatures are required in some services such as in the boiler industries. As the boiler becomes larger and of an ultra-critical pressure type, higher heat resisting strength of the steels employed has been required for said services.

At present, JIS (Japanese Industrial Standards) SUS-29, SUS-43 steel and the like (AISI-321, AISI-347 and the like as similar standards) among 18 Cr-8Ni Austenitic stainless steels are generally employed for said services.

Generally speaking, Ti Nb, and the like are added to said austenitic stainless steels with a view of obtaining high temperature strength. However, the most suitable amounts of such additions to be capable of keeping good strength at elevated temperatures has not yet been made clear. In case of the above SUS-29 steel, the Ti addition amount of C% × 5 to 0.60% is specified and in SUS-43 steel, the Nb addition amount of C% × 10 to 1.00%. Such additions stated above are to reduce intergranular corrosion by causing stable carbides of TiC or NbC to precipitate, since carbide, precipitating as $Cr_{23}C_6$ at the grain boundry causes said intergranular corrosion.

It is, however, an undeniable fact that the creep rupture strength of these steels, which contain the above amount of Ti or Nb, in service for a long period of time such as $10^4$ to $10^5$ hours at elevated temperatures of 600° to 700°C is rather less than that of SUS-27 steel (AISI-304 steel), which contains no strengthening element such as Ti, Nb or the like. Therefore, the improving of a heat resisting steel having excellent creep rupture strength for the above services and at a low cost has been called for.

According to many experiments, it has been shown that the increase of Ti, Nb or the like in steel at random does not always result in an improvement of the heat resisting strength and creep rupture strength for a long period at elevated temperature. When the above range is controlled in relation to other elements, especially the C content, and the grain size is controlled to a specific range, the highest strength in said services may be stabely obtained. Thus, the addition of the elements in this invention is specified in relation to an atomic ratio of C to said elements, i.e. 1.3 to 7, preferably 3 to 6, and the grain size, within the range of ASTM No. 3 to 8.

A main object of the present invention is to provide a Cr-Ni system heat resisting steel exhibiting high heat resistance in services for a long period of time at elevated temperatures, with a low cost.

Additional objects of this invention will become apparent by the following description referring to the examples and with the accompanying drawing in which:

FIG. 1 is a graph showing the creep rupture strength affected by the atomic ratio of C to Ti+Nb(Ta) in cases where steels are subjected to elevated temperatures for a long period of time.

A heat resisting steel of the present invention is characterized in that the atomic ratio of C to Ti+Nb(Ta) in steel is within the range of 1.5 to 7, preferably 3 to 6, and the grain size, ASTM No. 3 to 8. Such a steel consists in the following chemical composition:

C: 0.05 to 0.30% by weight
Si: up to 1.0% by weight
Mn: up to 2.0% by weight
Cr: 15.0 to 26.0% by weight
Ni: 7.0 to 22.0% by weight
Ti: 0.01 to 0.80% by weight and/or Nb(Ta): 0.01 to 1.6% by weight In the above content The atomic ratio of C to Ti and/or Nb(Ta): 1.3 to 7, preferably, 3 to 6, which is determined by the following formula;

$$\text{The atomic ratio} = \frac{\dfrac{\text{C wt\%}}{\text{C awt}}}{\dfrac{\text{Ti wt\%}}{\text{Ti awt}} + \dfrac{\text{Nb (Ta) wt\%}}{\text{Nb (Ta) awt}}} \text{ or } \frac{\dfrac{\text{C wt\%}}{\text{C awt}}}{\dfrac{\text{Ti wt\%}}{\text{Ti awt}}} \text{ or } \frac{\dfrac{\text{C wt\%}}{\text{C awt}}}{\dfrac{\text{Nb (Ta) wt\%}}{\text{Nb (Ta) awt}}}$$

where, wt%: weight %
awt: atomic weight unavoidable impurities and the balance being Fe. (Ta is considered to be an impure element in Nb)

The reason why the relation of C content to Ti and/or Nb (Ta) content is further limited in relation to said atomic ratio as mentioned above, while each C, Ti and/or Nb(Ta) is specified such as 0.05 to 0.30% for carbon and so, lie in the restraining of bad influences on heat resistance of steel in the services for a long period of time at elevated temperatures. That is, carbides, i.e. $M_{23}C_6$, increased as said atomic ratio is over 7 coalesce in said services and result in the lowering of strength thereby. In case of an atomic ratio of less than 1.3, C in the steel is fixed as Ti and/or Nb(Ta) carbide and, consequently, the lowering of the strength the steel is brought about by reason of which there is little solute carbon playing an important part to improve said strength of the steel. On the contrary, when said atomic ratio is within the range of 1.3 to 7 proper amounts of TiC and/or Nb(Ta) C precipitate to make uniform precipitation of $M_{23}C_6$ and to depress its coalescence. The behavior of the above carbides results in the improving of the strength of the steel in said services. From the above-mentioned point of view, the upper and lower limits of Ti and/or Nb(Ta) are specified in relation with those of said atomic ratio respectively. That is, when Ti or Nb(Ta) is less than that of said lower limit, i.e. 0.01% respectively, there is no importance in said strength, and when Ti or Nb(Ta) is more than that of said upper limit, i.e. 0.80% or 1.6% respectively, it is fruitless from the quality and economical point of view.

Next, the range of the chemical composition of the main elements as mentioned above except Ti and Nb(Ta), is determined by reason of the following. C content of 0.05 to 0.30% is the most suitable range in relation to the above content of Ti and/or Nb(Ta). A content of less than 0.05% C does not cause an improvement of said strength and a content of more than 0.30% C brings about deterioration of said creep rupture strength in services for a long period of time at elevated temperatures because of the increasing of said $Cr_{23}C_6$ and the leading to coalescence of said carbides in said services. Less than 15.0% Cr brings about a change of oxidation resistance for the worse, while more than 26.0% Cr produces δ phase and becomes hard to obtain the fully austenitic phase because of the unbalance among those elements. Similarly, with less than 7.0% Ni it is also hard to get full austenite. It is expensive to add Ni content of more than 22.0%.

The grain size of the steel consisting of the above-mentioned composition should be controlled within the range of ASTM No. 3 to 8 by proper heat treatment on finished products. When said grain size as hot-rolled is within said range, the steel can be used as it is. Because the heat resisting strength of steel having a grain size of over No. 8 remarkable lowers in the services for a long period of time elevated temperatures. Such a solution heat-treatment is as follows.

That is, said solution heat-treatment is carried out at a temperature of more than 1050°C for a proper time, e.g. 5 to 30 minutes. The steel is water-quenched after said solution treatment.

Thus, the present invention is characterized in that said composition is prepared as mentioned above and then the crystal grain size thereof is controlled within the range of ASTM No. 3 to 8, if necessary, by the above-mentioned solution heat-treatment, such features was confirmed by the following fundamental experiments. All of steels in the following examples are well known.

TABLE A

| | Chemical composition (by weight %) | | | | | | | | |
|---|---|---|---|---|---|---|---|---|---|
| No. | C | Si | Mn | Cr | Ni | Ti | Nb(Ta) | Atomic ratio $\frac{C}{Ti + Nb(Ta)}$ | Note |
| 31 | 0.06 | 0.06 | 1.71 | 19.01 | 10.53 | — | — | — | SUS-27 |
| 1 | 0.07 | 0.54 | 1.52 | 7.47 | 12.16 | 0.44 | — | 0.63 | SUS-29 |
| 2 | 0.05 | 0.63 | 1.67 | 17.07 | 12.50 | — | 0.78 | 0.50 | SUS-43 |

Remark:
i) heat treatment 1100°C × 30 min., water quenched.
ii) creep rupture strength of the steels is shown in Table B, respectively.

TABLE B

| | Creep rupture strength (Kg/mm²) | | | | | |
|---|---|---|---|---|---|---|
| | 600°C | | 650°C | | 700°C | |
| No. | $10^4$hr. | $10^5$hr. | $10^4$hr. | $10^5$hr. | $10^4$hr. | $10^5$hr. |
| 31 | 14.3 | 12.0 | 9.0 | 6.5 | 6.0 | 4.3 |
| 1 | 19.0 | 15.0 | 10.8 | 7.5 | 6.5 | 4.0 |
| 2 | 19.0 | 13.0 | 12.5 | 8.0 | 7.5 | 4.0 |

The creep rupture test was carried out on the samples of the conventional austenitic heat-resisting steels in Table A under the same solution heat-treatment. According to the above Table B, it will be understood that said strength of the steel in use for a long period of time at elevated temperatures is not always improved even if Ti or Nb(Ta) was further added. That is, said strength of SUS-27 (AISI-304) steel for $10^5$hr. at 700°C is rather better than that of SUS-29 (AISI-321) steel and SUS-43 (AISI-347) steel. Thus, it should be noted that the required strength is impossible to be secured by only solution heat-treatment.

Next, the influences of heat treatment on said strength was put to a test of steels having compositions based on the present i.e. brings i.e. This composition invention.

TABLE C

| | Chemical composition (by weight %) | | | | | | | |
|---|---|---|---|---|---|---|---|---|
| No. | C | Si | Mn | Cr | Ni | Ti | Nb(Ta) | Atomic ratio $\frac{C}{Ti + Nb(Ta)}$ |
| 32 | 0.11 | 0.54 | 1.50 | 17.88 | 9.92 | 0.03 | 0.14 | 4.4 |
| 33 | 0.15 | 0.58 | 1.51 | 17.96 | 9.98 | 0.07 | 0.22 | 3.3 |

TABLE D

| | Result of heat treatment | | |
|---|---|---|---|
| No. | Heat treatment °C | Grain size ASTM No. | Creep rupture strength 650°C × $10^5$(Kg/mm²) |
| | 950 | 10.0 | 7.6 |
| 32 | 1,100 | 6.5 | 11.9 |
| | 1,200 | 4.8 | 13.0 |
| | 950 | 9.5 | 7.8 |
| 33 | 1,100 | 7.0 | 12.2 |
| | 1,200 | 4.6 | 11.7 |

Remark:
C° × 30 min, water-quenched

According to the above Table D, in case of which said heat treatment is carried out at 950°C, said grain size is very small, i. e. ASTM No. 10.0 or 9.5, and consequently beings about the lowering of the creep rupture strength, i. e. 7.6 Kg/mm² or 7.8 Kg/mm². It will be understood that such values are similar to that of steel 31 in Table B. this fact shows that said grain size by a heat treating temperature of 950°C is still too small and is not effective for improving said strength even if said chemical compositions was suitable, at the same time, said grain size of ASTM No. 3 to 8 and said heat treating temperature of 1050°C and more are required.

In the case in which steel is employed as hot-rolled, such a grain size is possible to be controlled by adjusting the hot-finished operation at a suitable rolling temperature, which does not always have to be subjected to the above-mentioned heat treatment. Accordingly, the necessity of said heat treatment depends upon said grain size of hot-rolled material consisting of the above-mentioned composition. In any case, said grain size has not to be coarsened to a level of less than ASTM No. 3. Because, cold workability of such a steel becomes worse and said steel comes short of its creep rupture elongation.

The features as mentioned above will be further apparent by the following examples.

Table 1

(by weight %)

| No. | C | Si | Mn | Cr | Ni | Ti | Nb(Ta) | C / (Ti + Nb(Ta)) Atomic ratio | Note |
|---|---|---|---|---|---|---|---|---|---|
| 3 | 0.14 | 0.56 | 1.44 | 15.75 | 11.45 | — | 1.10 | 0.90 | Comparative |
| 4 | 0.03 | 0.70 | 1.51 | 17.83 | 9.57 | 0.10 | 0.18 | 0.62 | Comparative |
| 5 | 0.12 | 0.72 | 1.14 | 20.37 | 9.27 | 0.03 | 0.02 | 11.90 | Comparative |
| 6 | 0.13 | 0.53 | 1.51 | 15.94 | 10.62 | 0.09 | — | 5.80 | Inventive Steel |
| 7 | 0.14 | 0.58 | 1.49 | 15.59 | 11.56 | — | 0.54 | 3.20 | Inventive Steel |
| 8 | 0.13 | 0.63 | 1.49 | 16.01 | 11.50 | — | 0.76 | 1.32 | Inventive Steel |
| 9 | 0.16 | 0.58 | 1.47 | 18.29 | 9.86 | 0.09 | 0.13 | 4.06 | Inventive Steel |
| 10 | 0.13 | 0.58 | 1.47 | 18.47 | 9.98 | 0.09 | 0.29 | 2.15 | Inventive Steel |
| 11 | 0.16 | 0.50 | 1.45 | 18.20 | 9.86 | 0.08 | 0.30 | 2.72 | Inventive Steel |
| 12 | 0.12 | 0.68 | 1.20 | 20.28 | 9.16 | 0.02 | 0.098 | 6.80 | Inventive Steel |

Remark:
Grain size of steels is controlled within the range of ASTM No. 3 to 8.
Creep rupture strength of the above steels are shown in Table II.

TABLE II (Kg/mm²)

| No. | 600°C $10^4$ hr. | 600°C $10^5$ hr. | 650°C $10^4$ hr. | 650°C $10^5$ hr. | 700°C $10^4$hr. | 700°C $10^5$ hr. |
|---|---|---|---|---|---|---|
| 3 | 18.5 | 14.0 | 12.2 | 9.4 | 7.0 | 5.2 |
| 4 | 17.5 | 13.5 | 11.5 | 8.4 | 7.3 | 5.3 |
| 5 | 19.5 | 14.7 | 12.6 | 9.0 | 7.6 | 5.5 |
| 6 | 20.5 | 15.7 | 14.0 | 11.0 | 9.3 | 6.5 |
| 7 | 21.5 | 16.8 | 15.5 | 12.5 | 10.0 | 7.8 |
| 8 | 18.5 | 13.7 | 12.5 | 9.5 | 7.8 | 6.0 |
| 9 | 21.5 | 16.8 | 15.5 | 12.3 | 10.6 | 8.0 |
| 10 | 20.0 | 15.5 | 13.0 | 10.0 | 9.4 | 7.2 |
| 11 | 21.0 | 16.0 | 14.0 | 11.0 | 9.6 | 7.6 |
| 12 | 20.3 | 15.5 | 12.6 | 9.5 | 8.2 | 6.0 |

Referring now to the above tables, it is apparent that the creep rupture strength of the group of steel 3 to 5 is different from that of the group of steel 6 to 12. That is, the strength of the former is within range of 5.2 Kg/mm² to 5.5 Kg/mm² and that of the later is within the range of 6.0 Kg/mm² to 8.0 Kg/mm², at 700°C × $10^5$ hours test respectively. This distinction is, of course, based on the difference of the atomic ratio. It will be, from these studies, understood that the atomic ratio of from 1.3 to 7, preferably from 3 to 6, is the best suited range in the interest of improving said heat resisting strength. Further, the effects of C content on said creep rupture strength of steels were tested by making the following Examples. These Examples were controlled to obtain the atomic ratio of about 4 and the grain size of ASTM No. 3 to 8.

TABLE III (by weight %)

| No. | C | Si | Mn | Cr | Ni | Ti | Nb(Ta) | C / (Ti + Nb(Ta)) Atomic Ratio |
|---|---|---|---|---|---|---|---|---|
| 22 | 0.03 | 0.58 | 1.51 | 17.96 | 9.98 | 0.015 | 0.030 | 4.0 |
| 23 | 0.05 | 0.49 | 1.35 | 17.35 | 9.80 | 0.20 | 0.05 | 4.4 |
| 24 | 0.08 | 0.47 | 1.28 | 18.67 | 10.27 | 0.03 | 0.08 | 4.5 |
| 25 | 0.11 | 0.54 | 1.50 | 17.88 | 9.92 | 0.03 | 0.14 | 4.3 |
| 9 | 0.16 | 0.58 | 1.47 | 18.29 | 9.86 | 0.09 | 0.13 | 4.1 |
| 26 | 0.20 | 0.64 | 1.41 | 18.14 | 9.98 | 0.11 | 0.21 | 3.7 |

TABLE IV (creep rupture strength by Kg/mm²)

| No. | 650° C $10^4$ hr. | 700° C $10^4$ hr. |
|---|---|---|
| 22 | 12.1 | 7.5 |
| 23 | 13.4 | 8.7 |
| 24 | 14.2 | 9.5 |
| 25 | 15.0 | 10.0 |
| 9 | 15.5 | 10.6 |
| 26 | 15.9 | 10.8 |

Remark:
No. 9 is the same as that of Table I.

According to the above results, the creep rupture strength of No. 22 steel is relatively low. It should be noted that improvement of said creep rupture strength in case of 0.03% C, i.e. steel 22, is not yet sufficient. That is, more than 0.5%, preferably more than 0.08% C is desirable to improve said creep rupture strength in the services for a long period of time at elevated temperatures.

The accompanying drawing shows the changes of creep rupture strength depending on many kinds of atomic ratio of C to (Ti+Nb+Ta) at various elevated temperatures. According to said drawing, it will be easily understood that there is marked lowering in said strength of the steel having said atomic ratio of less than 1.3, while all of carbon is fixed at Ti and Nb carbides. Similarly, a marked lowering in said strength of the steel having said atomic ratio of more than 7 is caused by too much solution carbon resulting in precipitation as $Cr_{23}C_6$ and further coalescence thereof.

It is like Table II and FIGURE that said strength of the steel holding atomic ratio of 3 to 6 is demonstrated as the highest quality.

Thus, the matter as mentioned above is not other than how to select the range of said atomic ratio and control its grain size, exerting a crucial influence upon heat resisting strength of steel. According to the present invention, heat resisting strength, which was insufficient up to the present, may be remarkably improved with a lower cost. The austenitic heat resisting steel of the present invention is possible to be broadly employed in many fields of industrial circles. In particular, tubular products for boiler industry is one of the best suited uses.

We claim:

1. A Cr-Ni system austenitic heat-resisting steel consisting by weight substantially of C: 0.05 to 0.30%,
Si: up to 1.0%,
Mn: up to 2.0%,
Cr: 15.0 to 26.0%
Ni: 7.0 to 22.0%, and at least one of
Ti: 0.01 to 0.8% and Nb: 0.01 to 1.7% and further, in the above contents, the atomic ratio of C to Ti and/or Nb is within the range of 1.3 to 7, which is calculated by the following formula:

$$\text{atomic ratio} = \frac{\frac{\text{C wt\%}}{\text{C awt}}}{\frac{\text{Ti wt\%}}{\text{Ti awt}} + \frac{\text{Nb wt\%}}{\text{Nb awt}}} \text{ or}$$

-continued $$\frac{\text{C wt\%}}{\text{C awt}} \quad \frac{\text{C wt\%}}{\text{C awt}}$$

or $$\frac{\text{Ti wt\%}}{\text{Ti awt}} \left[ \frac{\text{Nb wt\%}}{\text{Nb awt}} \right]$$

where:

wt% = weight %
awt = atomic weight and the grain size of said steel is within the range of ASTM No. 3 to 8.

2. An austenitic heat-resisting steel as set forth in claim 1, wherein said C content is within the range of 0.08 to 0.30%.

3. An austenitic heat-resisting steel as set forth in claim 2 wherein said atomic ratio is within the range of 3 to 6.

* * * * *